US008485526B2

(12) United States Patent
Toma

(10) Patent No.: US 8,485,526 B2
(45) Date of Patent: Jul. 16, 2013

(54) AIR SOCCER GAME

(76) Inventor: Ovidiu Toma, Montreal (CA)

( * ) Notice: Subject to any disclaimer, the term of this patent is extended or adjusted under 35 U.S.C. 154(b) by 55 days.

(21) Appl. No.: 13/199,471

(22) Filed: Sep. 1, 2011

(65) Prior Publication Data

US 2013/0056928 A1 Mar. 7, 2013

(51) Int. Cl.
*A63B 67/00* (2006.01)
*A63F 7/06* (2006.01)

(52) U.S. Cl.
USPC ..... 273/108.1; 273/108.53; 273/108.57

(58) Field of Classification Search
USPC ..... 273/108, 108.1, 108.51, 108.52, 273/108.53, 108.54, 108.55, 108.56, 108.57, 273/129 R, 129 AP
See application file for complete search history.

(56) References Cited

U.S. PATENT DOCUMENTS

| | | | | |
|---|---|---|---|---|
| 1,756,299 | A * | 4/1930 | Owens | 273/317.3 |
| 3,038,725 | A * | 6/1962 | Stewart et al. | 273/119 B |
| 3,113,776 | A * | 12/1963 | Romei | 273/108.57 |
| 3,771,789 | A * | 11/1973 | Kammerl | 273/108.57 |
| 4,014,543 | A * | 3/1977 | Arad | 273/108.53 |
| 5,288,071 | A * | 2/1994 | Solomon | 273/317.3 |
| 5,372,367 | A * | 12/1994 | McKendrick | 273/348.4 |
| 7,673,877 | B2 * | 3/2010 | Ruddell | 273/126 A |
| 2011/0291355 | A1 * | 12/2011 | Toma | 273/108.57 |

* cited by examiner

*Primary Examiner* — Raleigh W Chiu

(57) ABSTRACT

An air game apparatus. The apparatus comprises a table. The table comprises a horizontal top surface and peripheral side walls. A plurality of manual pneumatic mechanisms projects air in a substantial manner from each outlet, across the top surface of the table. The plurality of manual pneumatic mechanisms are positioned between top surface and bottom surface and have outlets and handles. One play object is positionable on the top surface of the table. The projected air streams move the play objects on the top surface of the table under the control of opposing players manipulating each of the plurality of manual pneumatic mechanisms with manual pumps, manipulating the direction of the air streams by rotation of outlets and produced the compressed-air necessary to move the playing object.

7 Claims, 4 Drawing Sheets

AIR SOCCER GAME

FIELD OF THE INVENTION

The invention generally relates to games. More particularly, the invention relates to a game with manual pneumatic mechanism with manual pumps selected from a group comprising bellows and manual pistons, means to move a play object across a play surface by directed air impulses.

BACKGROUND OF THE INVENTION

Several different games including foosball, table hockey and billiards are played on a miniaturized surface typically supported on a table. Different systems and methods have been developed to move play objects in such games.

U.S. Pat. No. 7,673,877 discloses a game that uses an electric source of compressed gas to move play objects across play surface. A triggering device is used by players to select one or several jets in order to control movement of the play object.

U.S. Pat. No. 3,113,776 discloses a pneumatic board game apparatus that uses an electric source of compressed air to move play objects across play surface. The triggering device is positioned on each side of game table to rotate players and hit the ball.

U.S. Pat. No. 3,771,789 discloses an air action game with the same electric source of compressed gas to move play objects across play surface. The triggering device is positioned in each corner of the table and in the middle.

U.S. Pat. No. 4,014,543 discloses a pneumatic board game with the same electric source of compressed gas to move play objects. The triggering device is central positioned and can be rotated to orientate the air stream.

CA 2,712,532 discloses a pneumatic soccer game with manual pumps disposed in each corner of the field. The manual pumps can be rotated at 90 degrees to orientate the air jet.

However, there is still presently a need for an air apparatus that doesn't use an electric source of compressed air, to produce and orientate the air jet by hand, that can improve the hand-eye coordination of the players displacing playing pieces on the game surface.

SUMMARY OF THE INVENTION

An object of the present invention is to provide an air soccer game apparatus that satisfies the above-mentioned need.

According to the present invention, there is provided an air soccer game apparatus comprising:

- a table, said table comprising a horizontal top surface and peripheral side walls;
- a plurality of manual pneumatic mechanisms, included manual pumps means to project air in a substantially horizontal manner from each outlet;
- at least one play object positionable on the top surface of the table, whereby the projected air streams move said play object on said top surface of said table under a control of opposing players manipulating each of said plurality of manual pneumatic mechanisms, included manual pumps and manipulating the direction of the air streams, through rotation of the plurality of the outlets.

Each manual pneumatic mechanism has the role to produce air stream, to control the air debit and orientate the air stream with no restriction of degree.

Manual pumps are selected from a group comprising bellows and manual pistons.

BRIEF DESCRIPTION OF THE DRAWINGS

These and other objects and advantages of the invention will become apparent upon reading the detailed description and upon referring to the drawings in which.

DETAILED DESCRIPTION OF PREFERRED EMBODIMENTS OF THE INVENTION

According to the present invention, as shown in FIGS. 1 to 4, there is provided an air soccer game apparatus.

Figure 1:
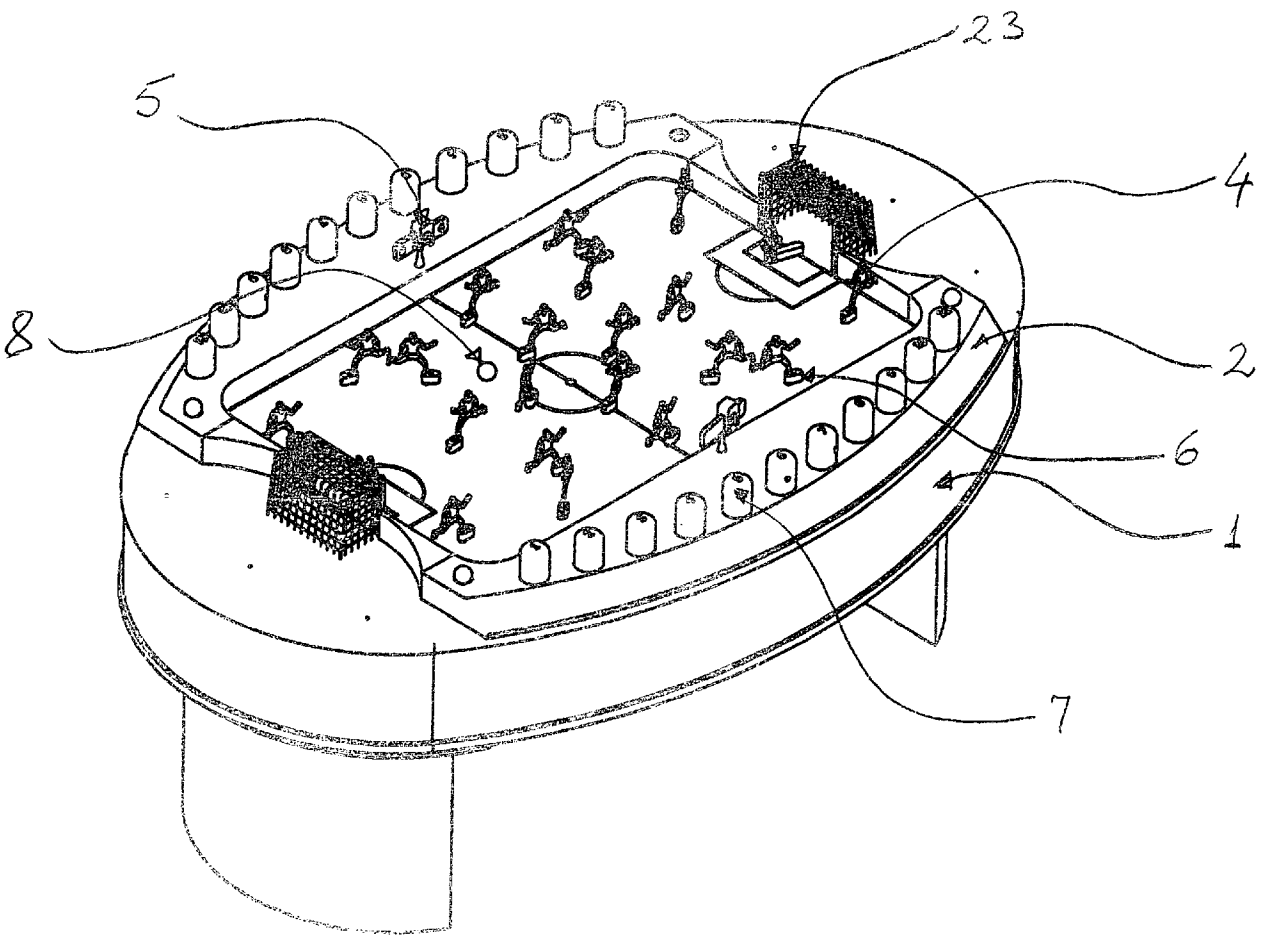
FIG. 1 is a perspective view of an air soccer game in accordance with a preferred embodiment of the present invention.
Figure 2:
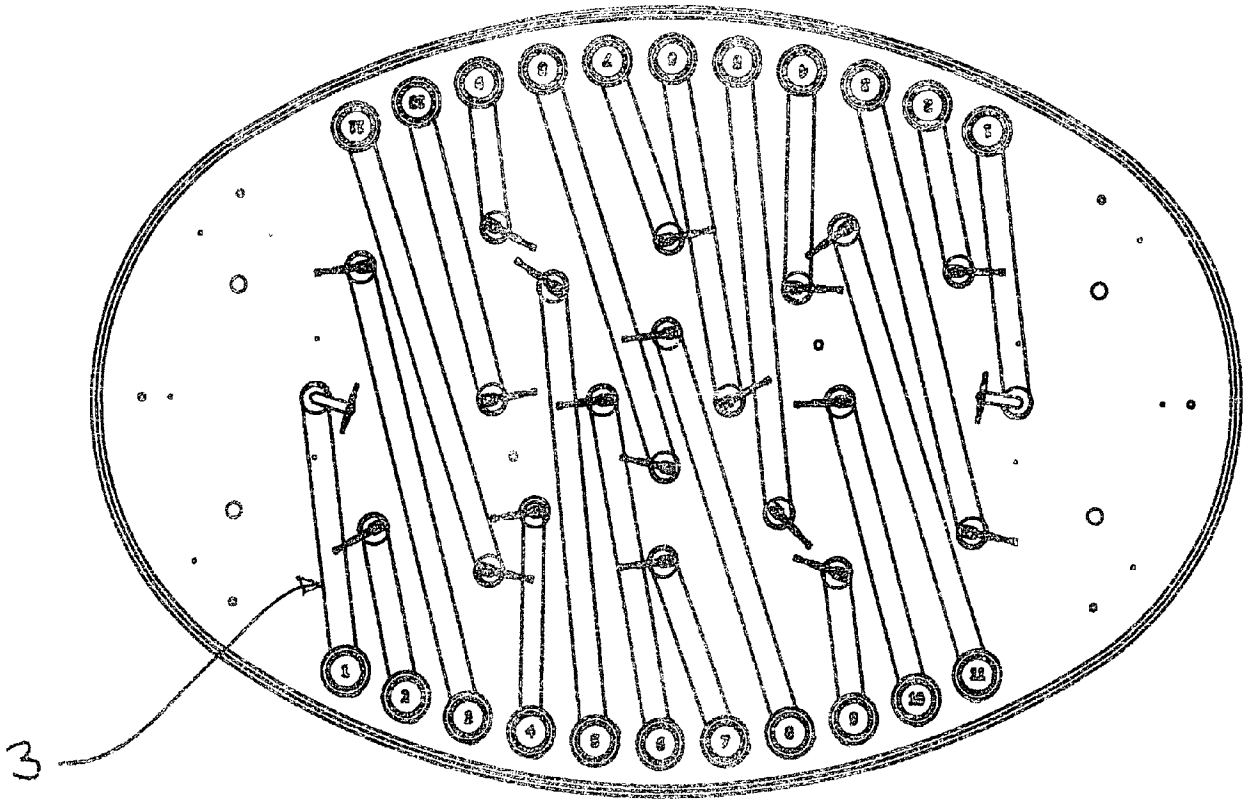
FIG. 2 is a top view of the air soccer game to show the disposition of the manual pneumatic mechanism.

The game apparatus is made up of the following principal components:

game table (1) FIG. 1.
walls (2) FIG. 1.
manual pneumatic mechanism (3) FIG. 2.
soccer gates (23) FIG. 1.
score (5) FIG. 1.
polystyrene ball (8) FIG. 1.

The game apparatus comprises a table (1). The table (1) comprises a horizontal top surface and peripheral side walls (2). The horizontal top (22) surface is provided with 22 holes (20) on the field, specially made for manual pneumatic mechanism, to let the pipe (18) to pass through those holes and 22 holes (21) to let the axle (14) have a vertical and rotation motion, well illustrated in FIG. 4.

The table (1) comprises also the manual pneumatic mechanism (3) which is situated inside, only the outlet (6), the players (4) and the handle (7) are visible.

The playing object is a polystyrene ball (8) very easy to play with a small debit of air.

Figure 3:
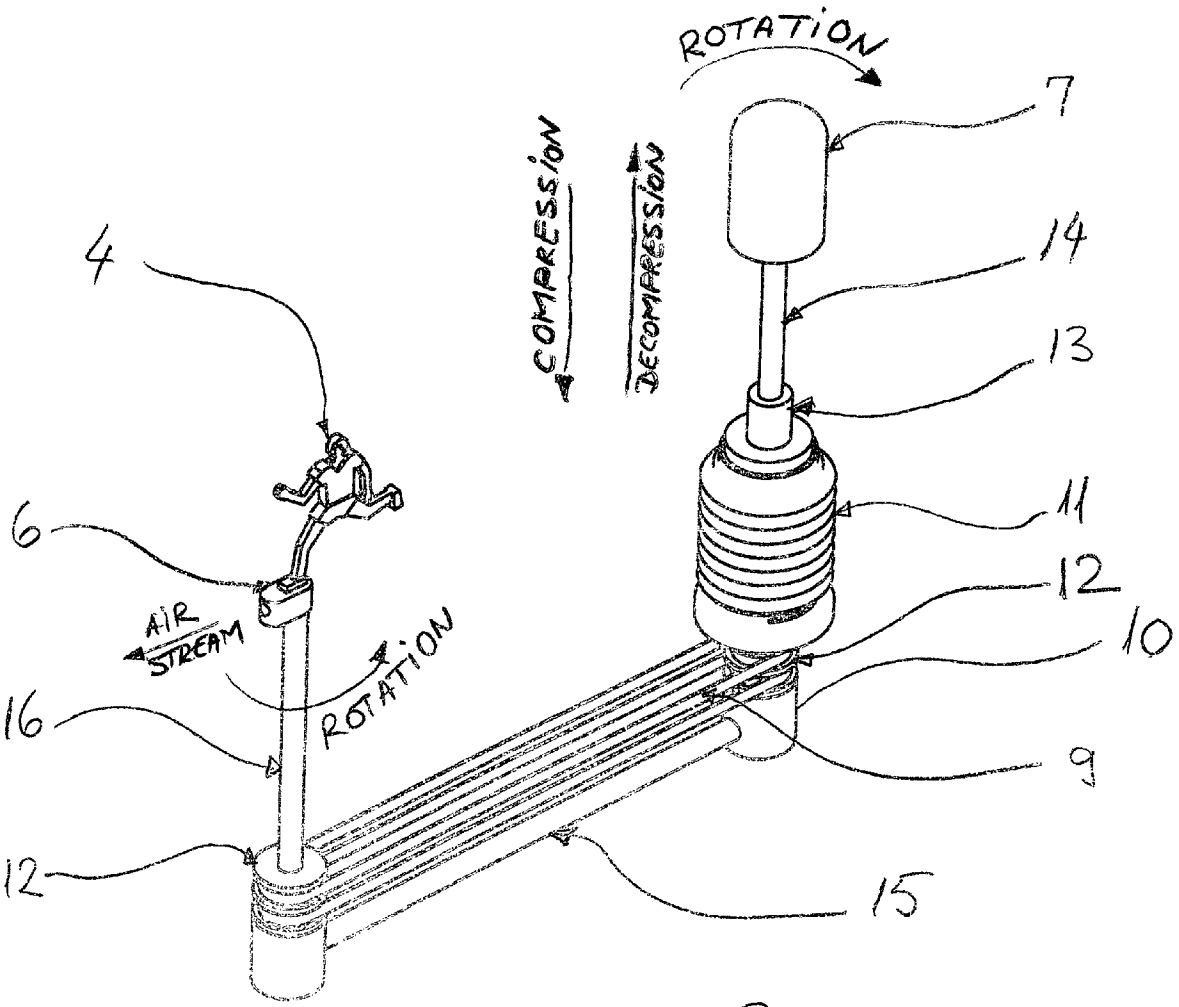
FIG. 3 is a perspective view of the manual pneumatic mechanism.
Figure 4:
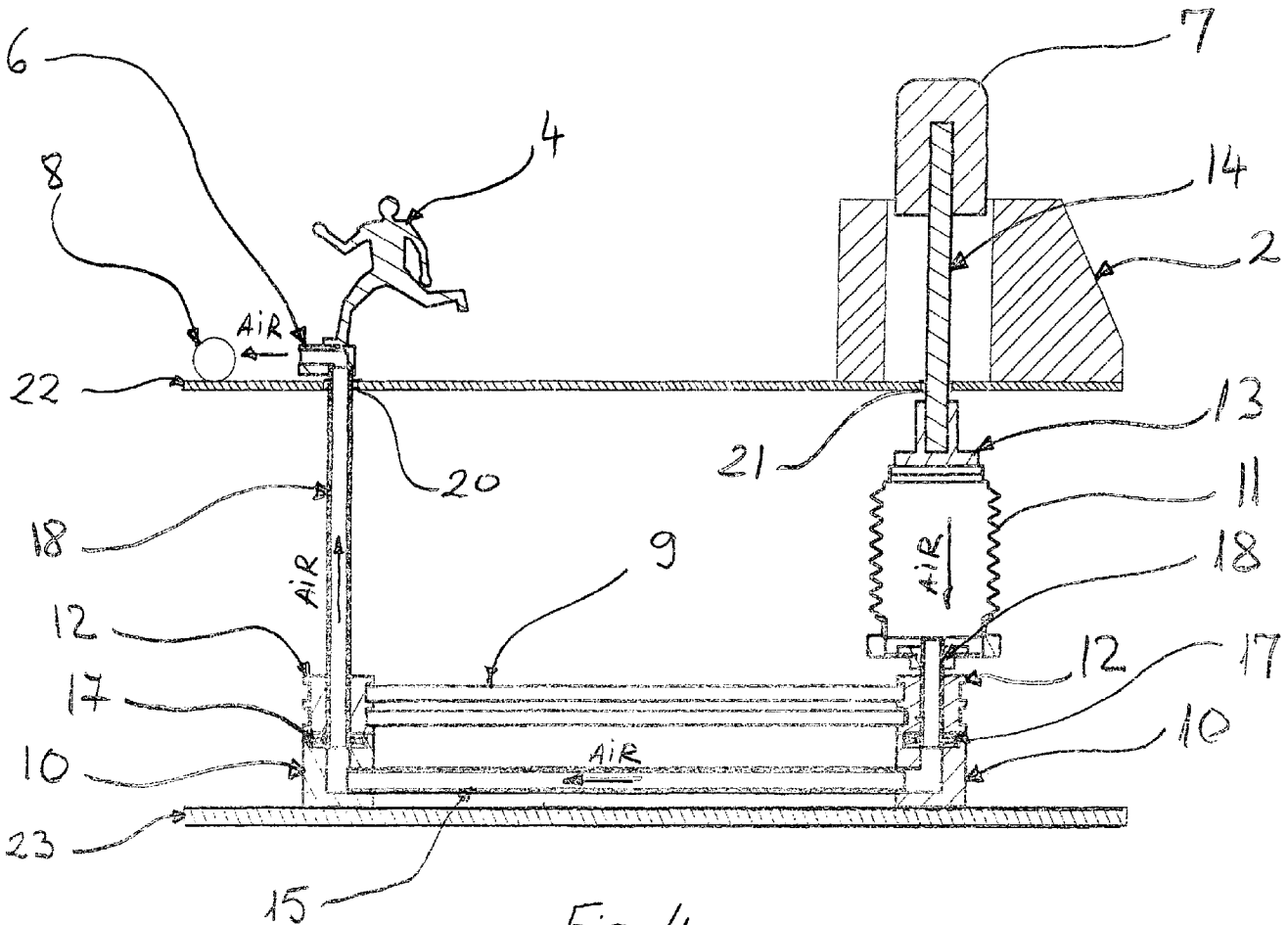
FIG. 4 is a cross-sectional view of FIG. 3—the manual pneumatic mechanism.

To move the play object on the top surface, the manual pneumatic mechanism, well illustrated in FIG. 3 and FIG. 4, is used. The manual pneumatic mechanism is made up of the following components:

handle (7), actioned by hand with two movements: rotation motion and vertical motion;
axle (14) which will transmit the vertical and rotation motion to the manual pump type bellows (11);
couple (13) between axle (14) and manual pump (11);
manual pump (11) selected from a group comprising bellows and manual piston whose role is to compress air through the evacuation outlet (6);
pipe (18) coupling between manual pump (11) and pulley (12);
radial bearings (17) that have the role to couple the elbow part (10), pulley (12) and pipe (18) and to eliminate the friction between pipe (18) and elbow part (10);
elbow part (10) rigidly fixed on the horizontal bottom surface (23), whose role is to change the direction of the air stream;
flexible horizontal pipe (15), whose role is to connect the two elbow parts together;
outlet (6) rigidly assembled with the pipe (18);

rubber belts (9) that will connect the two pulleys (12) together, whose role is to transfer motion rotation between two parallel axles;

and soccer figure player (4), rigidly fixed on the top of the outlet (6).

Supposing that the ball (8) will be positioned somewhere on the field; each competitor will choose the right handle (7) to orientate the right outlet (6) through the polystyrene ball (8). After positioning the outlet (6) on the right direction, they will press the handle (11) by hand, compressing the air, through the ball, and the air impulses produced will hit the ball, trying to push it into the opponent's goal. The handle (11) is released, and the elastic manual pump type bellows (11) will action like a spring, the cycle can be repeated. Each manual pneumatic mechanism works independently from the other manual pneumatic mechanisms. Each handle is numbered one to eleven corresponding to soccer players (4) also numbered one to eleven. To have the perception of direction, the players (4) will be orientated face to the ball (8). The speed of the ball can be controlled by air debit given directly by hand. The manual pneumatics mechanisms (3) are well positioned like in FIG. 2, to assure total control of the ball, irrespective of ball position.

This game can be played by 2, 3, 4, 5, or 6 players at the same time.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

The invention claimed is:

1. An air game apparatus comprising:

a table, said table comprising a horizontal top surface and peripheral side walls, said side walls extending above the top surface of the table;

a plurality of independent manual pneumatic mechanisms means, each mechanism means projecting from a handle towards a corresponding outlet from which air exits in a substantially horizontal manner across the top surface of the table, each mechanism means having a rotational axis being offset along the top surface of the table with respect to a rotational axis of the corresponding outlet, using a belt transmission means;

a belt transmission means for transmitting rotation between two parallel and different axes: the handle axis and the outlet axis; and, at least one play object positionable on the top surface of the table, whereby the projected air moves said play object on said top surface of said table under control of opposing players manipulating each of said plurality of manual pneumatic mechanism means, manipulating the direction of air through rotation of the outlets.

2. The air game apparatus of claim 1, wherein said manual pneumatic mechanism means can support four different motions on two different parallel axes, connected by said belt transmission means: handle rotation, handle compression, handle decompression and outlet rotation.

3. The air game apparatus of claim 1, wherein said plurality of manual pneumatic mechanism means is made with manual pumps, selected from a group comprising bellows and manual pistons actioned only by muscle force, excluding any other form of electric source.

4. The air game apparatus of claim 1, wherein the source of the projected air is a manual pump selected from a group comprising bellows and manual pistons.

5. The air game apparatus of claim 1, wherein the manual pneumatic mechanism means include two pulleys and one rubber belt.

6. The air game apparatus of claim 1, wherein the manual pneumatic mechanism means allows for an endless and continuous rotation of said handle and outlet using said belt transmission means.

7. The air game apparatus of claim 1, wherein said independent manual pneumatic mechanism means is selected from a group comprising bellows and manual pistons wherein said pneumatic mechanism means performs two simultaneous functions: producing air flow and rotating the outlet via the belt transmission means.

* * * * *